US007040376B2

(12) United States Patent
Nakao et al.

(10) Patent No.: US 7,040,376 B2
(45) Date of Patent: May 9, 2006

(54) METHOD FOR ENVELOPMENT CASTING

(75) Inventors: Yasuhiro Nakao, Sayama (JP); Hiroto Shoji, Sayama (JP); Kunitoshi Sugaya, Sayama (JP); Takashi Kato, Sayama (JP); Takaharu Echigo, Sayama (JP); Satoshi Matsuura, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 156 days.

(21) Appl. No.: 10/484,359

(22) PCT Filed: Jun. 26, 2002

(86) PCT No.: PCT/JP02/06428

§ 371 (c)(1),
(2), (4) Date: Jan. 20, 2004

(87) PCT Pub. No.: WO03/009955

PCT Pub. Date: Feb. 6, 2003

(65) Prior Publication Data

US 2004/0187965 A1 Sep. 30, 2004

(30) Foreign Application Priority Data

Jul. 23, 2001 (JP) ..... 2001-221261

(51) Int. Cl.
*B22D 19/14* (2006.01)

(52) U.S. Cl. ..... 164/97; 164/98

(58) Field of Classification Search ..... 164/57.1, 164/97, 98

See application file for complete search history.

(56) References Cited

U.S. PATENT DOCUMENTS

| | | | | |
|---|---|---|---|---|
| 5,669,434 | A * | 9/1997 | Nakao et al. | 164/97 |
| 5,934,355 | A * | 8/1999 | Nakao et al. | 164/97 |
| 6,303,236 | B1 * | 10/2001 | Nakao et al. | 428/654 |
| 6,609,286 | B1 * | 8/2003 | Nakao et al. | 29/412 |
| 6,880,681 | B1 * | 4/2005 | Koizumi et al. | 188/218 R |

FOREIGN PATENT DOCUMENTS

| | | |
|---|---|---|
| GB | 2 294 272 A | 4/1996 |
| JP | 10-005978 | 1/1998 |
| JP | 11-036975 | 2/1999 |
| JP | 11-107848 | 4/1999 |
| JP | 2000-233254 | 8/2000 |

* cited by examiner

*Primary Examiner*—Len Tran
(74) *Attorney, Agent, or Firm*—Rankin, Hill, Porter & Clark LLP

(57) ABSTRACT

A cast-bonding process includes a magnesium coating step and a magnesium nitride-forming step. The magnesium-coating step is carried out by supplying gasified magnesium into a mold in which a cast-in insert formed from an aluminum alloy, or an aluminum-based composite material is set, so that magnesium may coat the insert. The magnesium nitride-forming step is carried out by supplying nitrogen gas into the mold so that the coating magnesium and nitrogen gas may react to form magnesium nitride. Then, a molten aluminum alloy is poured into the mold for cast-bonding the insert.

8 Claims, 11 Drawing Sheets

METHOD FOR ENVELOPMENT CASTING

TECHNICAL FIELD

This invention relates to a cast-bonding process for cast-bonding with an aluminum alloy a cast-in insert formed from an aluminum alloy or an aluminum-based composite material.

BACKGROUND ART

The art of cast-bonding a cast-in insert formed from an aluminum alloy with an aluminum alloy is known from, for example, Japanese Patent Laid-Open Publication No. HEI-11-107848 entitled "Cylinder Liner Formed from a Powdered Aluminum Alloy". This cylinder liner formed from a powdered aluminum alloy is intended for enclosing in an aluminum alloy engine block, and the cylinder liner formed from a powdered aluminum alloy and the aluminum alloy engine block are so constructed that the thermal expansibility $\alpha C$ of the cylinder liner and the thermal expansibility $\alpha B$ of the engine block may satisfy $14\times10^{-6}/°$ C.$\leqq\alpha C\leqq20\times10^{-6}/°$ C. and $1\times10^{-6}/°$ C.$\leqq\alpha B-\alpha C\leqq8\times10^{-6}/°$ C. Such relationship between the cylinder liner and the engine block in thermal expansibility makes it possible to prevent the detachment of the cylinder liner from the engine block as it does not allow any clearance to be formed between their contact surfaces.

The outer surface of the cylinder liner and the inner surface of the engine block are, however, merely in contact with each other, and do not react or combine with each other.

Moreover, it is likely that when a molten aluminum alloy is poured, its surface may form an oxide film that may be caught and remain between it and the cylinder liner.

Moreover, the engine block increases its inside diameter considerably at a high temperature when the engine is in operation, but the cylinder liner does not increase its outside diameter very much, but becomes loose. For example, the inside diameter Di of the engine block and the outside diameter D of the cylinder liner have a diametrical clearance S of 0.192 mm formed therebetween ($S=8\times10^{-6}/°$ C.$\times300°$ C.$\times80=0.192$ mm) when their relationship in thermal expansibility is expressed as $\alpha B-\alpha C\leqq8\times10^{-6}/°$ C., when the outside diameter of the cylinder liner and the inside diameter of the engine block are both 80 mm, and when the operating temperature is 300° C. The clearance of 0.192 mm brings about a loose state (JIS B 0401).

According to the related art as described above, therefore, the clearance that is likely to occur between the engine block and the cylinder liner by the oxide film formed therebetween or the temperature of the engine in operation lowers the degree of their intimate contact due to e.g. a decrease in the area of their mutual contact and a reduction in their clamping pressure. As a result, a big difference is likely to occur to the cooling of the cylinder liners. Thus, the related art cannot be said to be perfect.

Therefore, there is a desire for a cast-bonding process that can form an improved bond between a cast-in insert, such as a cylinder liner, and a base material, such as an engine block.

DISCLOSURE OF THE INVENTION

According to the invention, there is provided a cast-bonding process characterized by comprising the cast-in insert setting step in which a cast-in insert formed from either an aluminum alloy or an aluminum-based composite material is set in the cavity of a mold; the magnesium coating step in which magnesium is supplied into the mold having the cast-in insert set therein, so that the magnesium may coat that surface of the cast-in insert which will contact a molten bath; the magnesium nitride forming step in which nitrogen gas is supplied into the mold so as to react with the coating magnesium to form magnesium nitride; and the cast-bonding step in which a molten aluminum alloy is poured into the mold after nitriding to enclose the cast-in insert.

The magnesium-coating step enables the coating of the cast-in insert with magnesium, as magnesium is supplied into the mold having the cast-in insert set therein. As a result, the following step ensures the formation of magnesium nitride on that surface of the cast-in insert which will contact the molten bath.

The magnesium nitride-forming step, in which nitrogen gas is supplied into the mold so as to react with the coating magnesium to form magnesium nitride, ensures the formation of magnesium nitride on that surface of the cast-in insert which will contact the molten bath, and also ensures the reduction with magnesium nitride of any oxide film formed on the aluminum alloy surface of the cast-in insert contacting the molten bath, or the alumina in an aluminum-based composite material for the cast-in insert. Magnesium nitride also serves for the reduction of any oxide film formed on the surface of the molten aluminum alloy that will be poured during the following step. As a result, it is possible to form a strong bond between that surface of the cast-in insert contacting the molten aluminum alloy, and the molten aluminum alloy. It is, therefore, possible to achieve an improved bonding between the cast-in insert formed from an aluminum-based composite material and the aluminum alloy.

The magnesium nitride-forming step according to the invention is preferably carried out by preheating nitrogen gas to an appropriate temperature outside the mold to promote the reaction of the nitrogen gas with the coating magnesium. Alternatively, the mold is heated to an appropriate temperature to promote the reaction of magnesium. As a result, the nitrogen gas supplied into the mold has a high temperature that facilitates the formation of magnesium nitride in the mold.

The heating of the mold is preferably carried out by using a cartridge heater to heat it in the vicinity of the cast-in insert. This ensures the elevation of the temperature of the nitrogen gas in the vicinity of the cast-in insert, as well as the temperature of the cast-in insert, and thereby its reaction with the magnesium coating the cast-in insert. Thus, it ensures the formation of magnesium nitride on that surface of the cast-in insert which will contact the molten bath. Moreover, the use of a cartridge heater for heating the mold ensures the heating of any desired part of the mold to any desired temperature.

BEST MODE OF CARRYING OUT THE INVENTION

Several preferred embodiments of the invention will now be described in detail with reference to the accompanying drawings.

Figure 1:
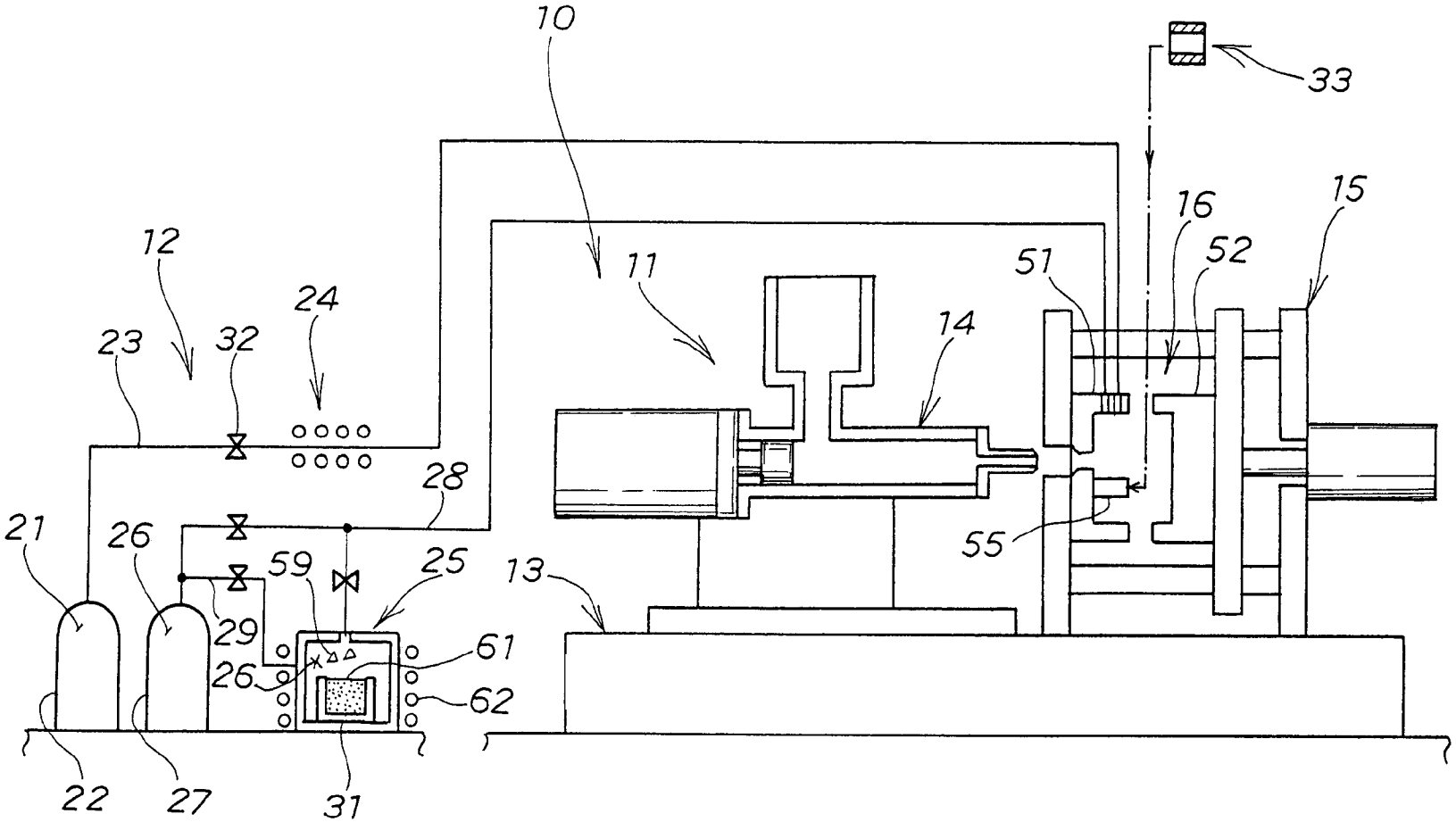
FIG. 1 shows a casting apparatus used for carrying out a cast-bonding process according to a first embodiment of the present invention.

A casting apparatus 10 according to the first embodiment as shown in FIG. 1 includes a die casting device 11 and a gas-supplying device 12. The die casting device 11 has a platform 13, and an extruder 14 and a clamping device 15 that are installed on the platform 13. The clamping device 15 has a mold 16.

The gas-supplying device 12 has a bottle 22 for nitrogen gas ($N_2$) 21, a supply pipe 23 for supplying nitrogen gas 21 to the mold 16, a nitrogen heating unit 24 installed in an appropriate position on the supply pipe 23, an atmosphere oven 25, a bottle 27 for argon gas (Ar) 26, a supply pipe 28 for supplying argon gas 26 to the mold 16 and a pipe 29 for supplying argon gas 26 to the atmosphere oven 25. A crucible 31 is installed in the atmosphere oven 25. The supply pipe 23 is equipped with a valve 32. A cast-in insert 33 is set in the mold 16. The nitrogen-heating unit 24 has, for example, a band heater as a heat source.

Figure 2:
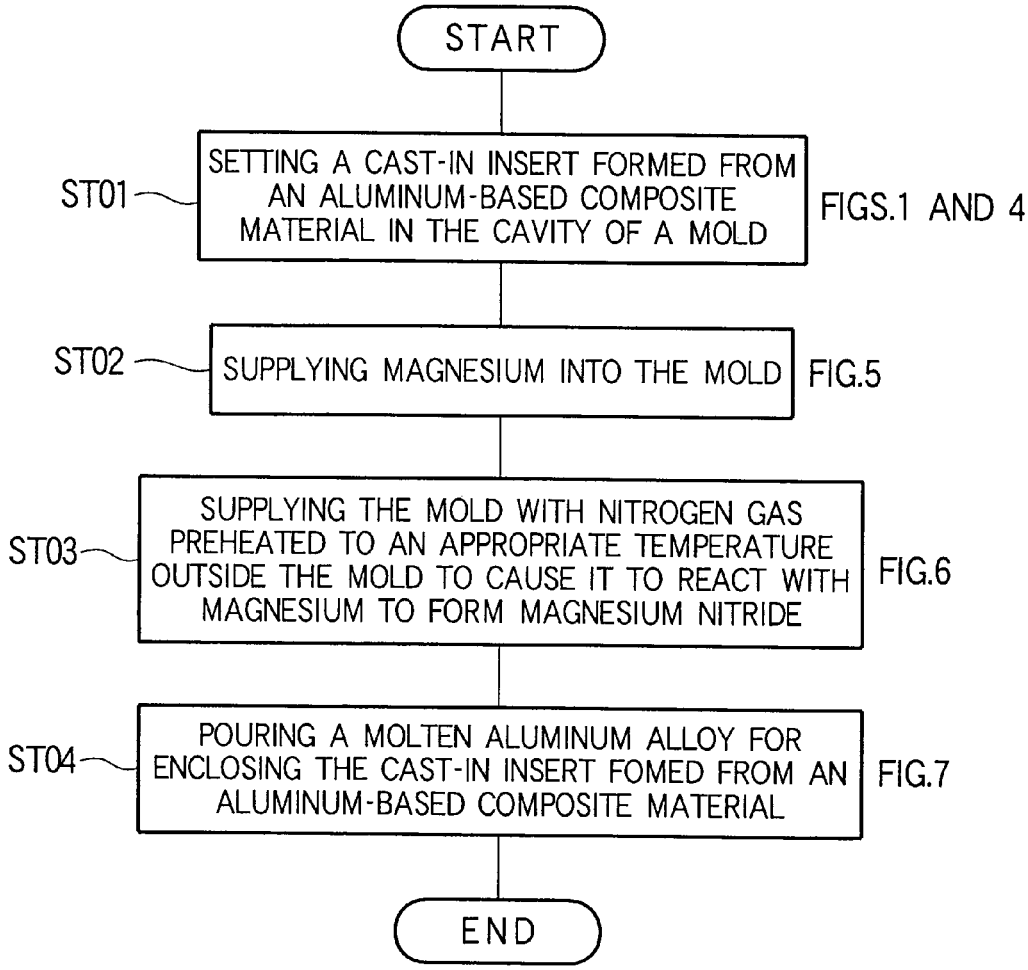
FIG. 2 is a flowchart showing the cast-bonding process in which the casting apparatus shown in FIG. 1 is employed.

The cast-bonding process according to the first embodiment of the invention that is carried out by employing the casting apparatus 10 will now be described with reference to the flowchart shown in FIG. 2.

Step (hereinafter abbreviated to ST) 01: The cast-in insert formed from an aluminum-based composite material is set in the cavity of the mold.

ST02: Magnesium is supplied into the mold.

ST03: Nitrogen gas preheated to an appropriate temperature outside the mold is supplied into the mold so as to react with magnesium to form magnesium nitride.

ST04: A molten aluminum alloy is poured to enclose the cast-in insert formed from an aluminum-based composite material.

Steps ST01 to ST04 will now be described more specifically.

FIGS. 3A to 3D show the steps of a process for preparing a cast-in insert according to the invention.

Figure 3A:
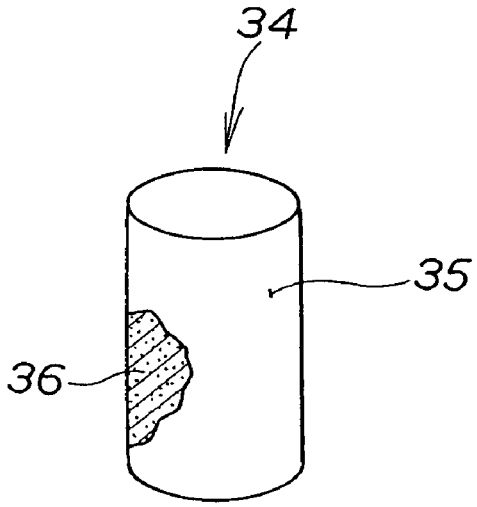
FIGS. 3A to 3D are schematic illustrations of a process for manufacturing the cast-in insert as shown in FIG. 2.

FIG. 3A shows a blank 34 for a cast-in insert. A cylindrical preform 35 of porous alumina ($Al_2O_3$) is impregnated with a molten aluminum alloy 36 to make an aluminum-based composite material.

Figure 3B:
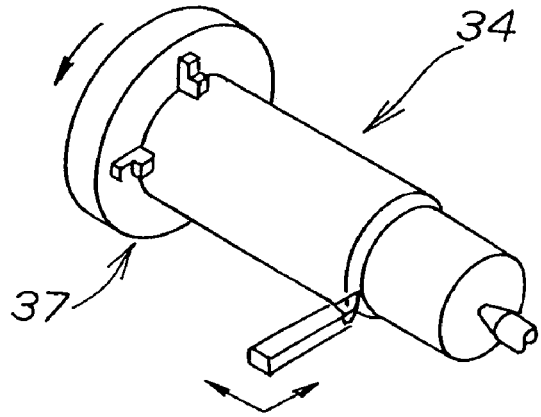

Then, the blank 34 is finished to a predetermined diameter by an NC (numerically controlled) lathe 37, as shown in FIG. 3B.

Figure 3C:
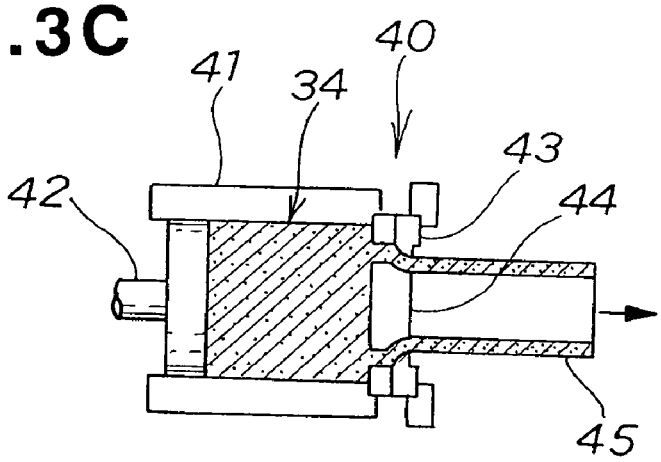

The blank 34 is cast-in inserted into the container 41 of an extruding press 40, and extruded by a ram 42 through a gap between a die 43 and a mandrel 44 to form a pipe 45, as shown in FIG. 3C.

Figure 3D:
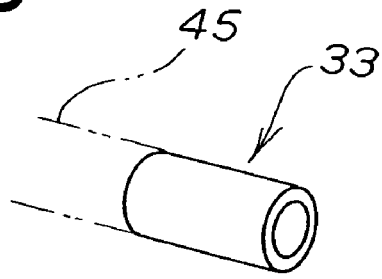

The pipe 45 is cut to an appropriate length to give a cast-in insert 33 formed from an aluminum-based composite material, as shown in FIG. 3D.

Figure 4:
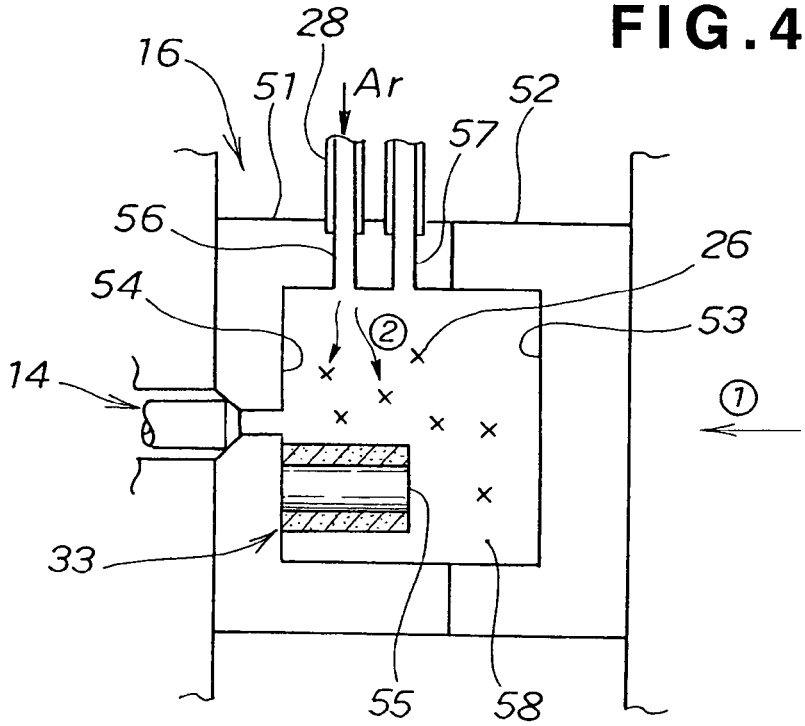
FIG. 4 is a schematic illustration of the step of setting the cast-in insert in a mold.

FIG. 4 shows the step of setting the cast-in insert in the mold.

Firstly, the cast-in insert 33 formed from an aluminum-based composite material is set in the mold 16. The mold 16 is composed of a stationary mold portion 51 and a movable mold portion 52. The movable mold portion 52 has a mold surface 53 formed therein. The stationary mold portion 51 has a mold surface 54 formed in its center, and having a cast-in insert-fitting portion 55 formed thereon, and has a sidewall in which gas supply ports 56 and 57 are formed. Reference numeral 58 denotes a cavity formed by the mold surfaces 53 and 54.

The cast-in insert 33 is fitted on the cast-in insert-fitting portion 55 of the stationary mold portion 51 of the mold 16, and then, the movable mold portion 52 is brought into tight contact with the stationary mold portion 51 as shown by arrow (1), whereby the cast-in insert 33 is set in the cavity 58 of the mold 16.

Then, argon gas 26 is supplied into the cavity 58 of the mold 16. More specifically, the extruder 14 is brought into contact with the mold 16, and argon gas 26 having an appropriate pressure is supplied into the mold 16 through the argon gas supply pipe 28 as shown by arrows (2) to form an atmosphere of argon gas 26 in the cavity 58, while oxygen is discharged from the cavity 58. The discharging of oxygen from the cavity 58 is carried out by, for example, the evacuation of the cavity 58 through a vacuum pump not shown, and when a certain vacuum degree has been reached, the vacuum pump is stopped and argon gas 26 is supplied.

Figure 5:
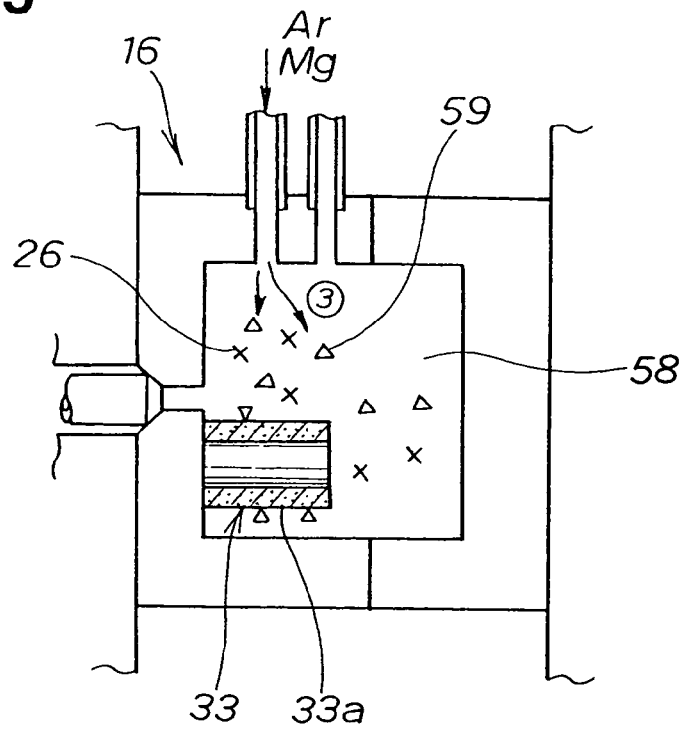
FIG. 5 is a schematic illustration of the step of coating the outer surface of the cast-in insert with magnesium.

FIG. 5 shows the step of supplying argon and magnesium gases into the mold cavity to coat the outer surface of the cast-in insert with magnesium.

Magnesium gas 59 is supplied into the mold 16. More specifically, solid magnesium (Mg) 61 is placed in the crucible 31 in the atmosphere oven 25 shown in FIG. 1, and heated by a heating coil 62 for vaporization. No oxidation of magnesium 61 occurs, since the atmosphere oven 25 has an atmosphere of argon gas 26 supplied through the supply pipe 29.

Then, argon gas 26 is supplied through the supply pipe 29 into the atmosphere oven 25 in which the vaporization of solid magnesium 61 has occurred, so that the pressure of argon gas 26 may cause argon gas 26 and magnesium gas 59 to be supplied into the mold 16 as shown by arrows (3) in FIG. 5. At the same time, the mold 16 is placed under suction.

Thus, the magnesium coating step ensures the formation during the following step of magnesium nitride on that surface 33*a* of the cast-in insert 33 which will contact a molten bath, since magnesium gas 59 is supplied into the mold 16 having the cast-in insert 33 set therein and coats that surface 33*a* of the cast-in insert 33 which will contact a molten bath.

Figure 6:
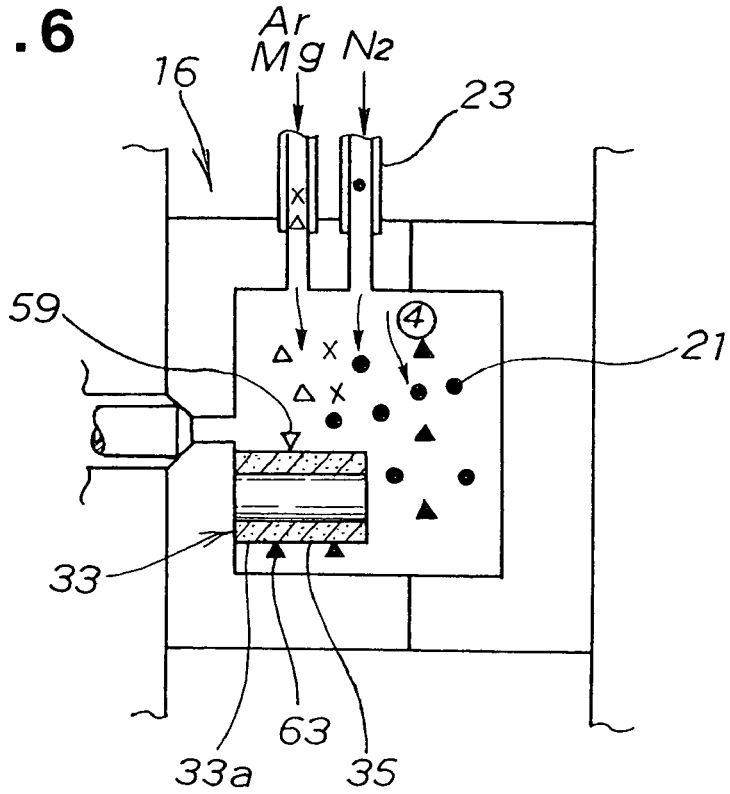
FIG. 6 is a schematic illustration of the step of forming magnesium nitride on the outer surface of the cast-in insert.

FIG. 6 shows the step of forming magnesium nitride on the outer surface of the cast-in insert.

In continuation, nitrogen gas 21 is supplied into the mold 16. More specifically, nitrogen gas 21 leaving the bottle 22 shown in FIG. 1 is heated to an appropriate temperature, such as about 400° C., in the nitrogen gas supply pipe 23 by the nitrogen heater 24, and supplied into the mold 16 as shown by arrows (4) in FIG. 6. The heated nitrogen gas 21 and magnesium gas 59 react with each other and form magnesium nitride ($Mg_3N_2$) 63. Magnesium nitride 63 reduces any oxide film formed on the aluminum alloy surface and the alumina ($Al_2O_3$) 35 in the aluminum-based composite material, and thereby improves the wetting property of alumina 35.

The magnesium nitride-forming step, in which nitrogen gas 21 is supplied into the mold 16 so as to react with magnesium gas 59 to form magnesium nitride 63, ensures the formation of magnesium nitride 63 on that surface 33*a* of the cast-in insert 33 which will contact the molten bath, and also ensures the reduction with magnesium nitride 63 of any oxide film formed on the surface 33*a* of the cast-in insert contacting the molten bath. Magnesium nitride 63 also serves for the reduction of any oxide film formed on the surface of the molten aluminum alloy that will be poured during the following step. As a result, it is possible to form a strong bond between the surface 33*a* of the cast-in insert 33 contacting the molten aluminum alloy, and the molten aluminum alloy. It is, therefore, possible to achieve an improved bonding between the cast-in insert 33 formed from an aluminum-based composite material, and the aluminum alloy.

Moreover, the magnesium nitride-forming step enables nitrogen gas 21 to undergo an improved reaction with the magnesium gas 59 coating that surface 33*a* of the cast-in insert 33 which will contact the molten bath, and facilitates the formation of magnesium nitride 63 on the surface 33*a* which will contact the molten bath, since the nitrogen gas 21 preheated to an appropriate temperature outside the mold 16 is supplied into the mold 16.

Figure 7:
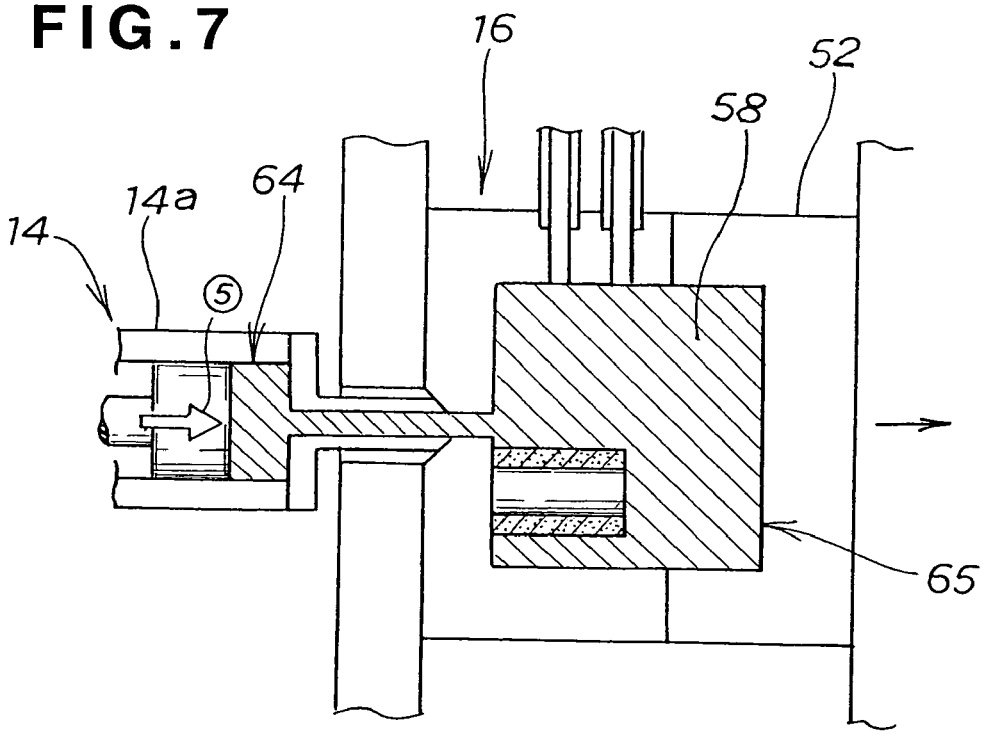
FIG. 7 is a schematic illustration of the step of cast-bonding the cast-in insert with an aluminum alloy.

FIG. 7 shows the step of cast-bonding the cast-in insert with an aluminum alloy.

After nitriding, a molten aluminum alloy 64 is supplied into the mold 16. More specifically, the molten alloy 64 is extruded at an appropriate pressure from the cylinder 14*a* of the extruder 14 as shown by an arrow (5) to fill the cavity 58, and is allowed to solidify.

Finally, the mold 16 is opened by moving the movable mold portion 52 upon solidification of the molten alloy 64, and a casting 65 as completed is taken out. This is the end of a cast-bonding cycle in which the cast-in insert 33 formed from an aluminum-based composite material is enclosed in an aluminum alloy.

Figure 8:
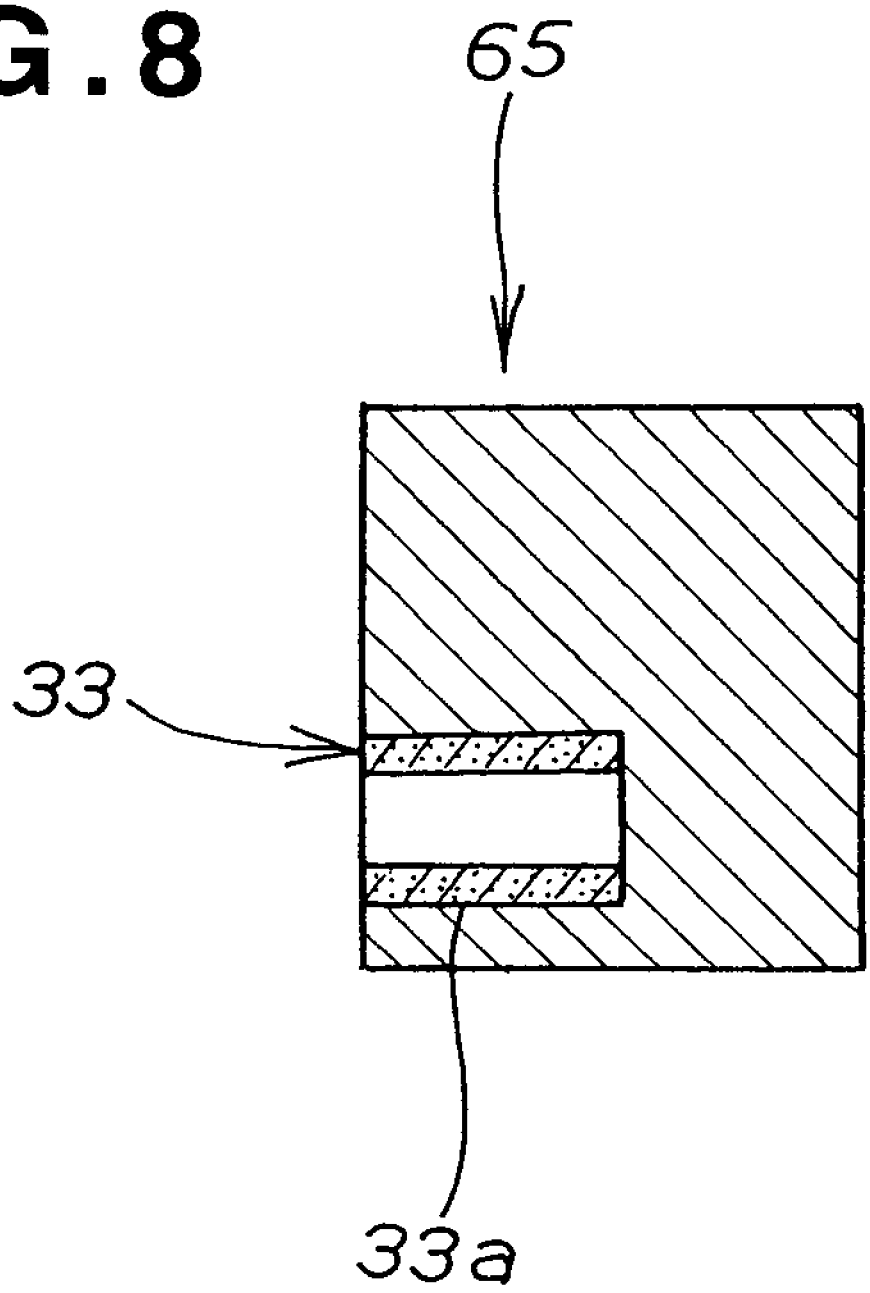
FIG. 8 shows a casting made by cast-bonding the cast-in insert with an aluminum alloy.

FIG. 8 shows the casting 65 made by cast-bonding the cast-in insert 33 formed from an aluminum-based composite material with the aluminum alloy. The casting 65 is not particularly limited in its use, but may, for example, provide a cylinder block for an engine made of an aluminum alloy.

Figure 9:
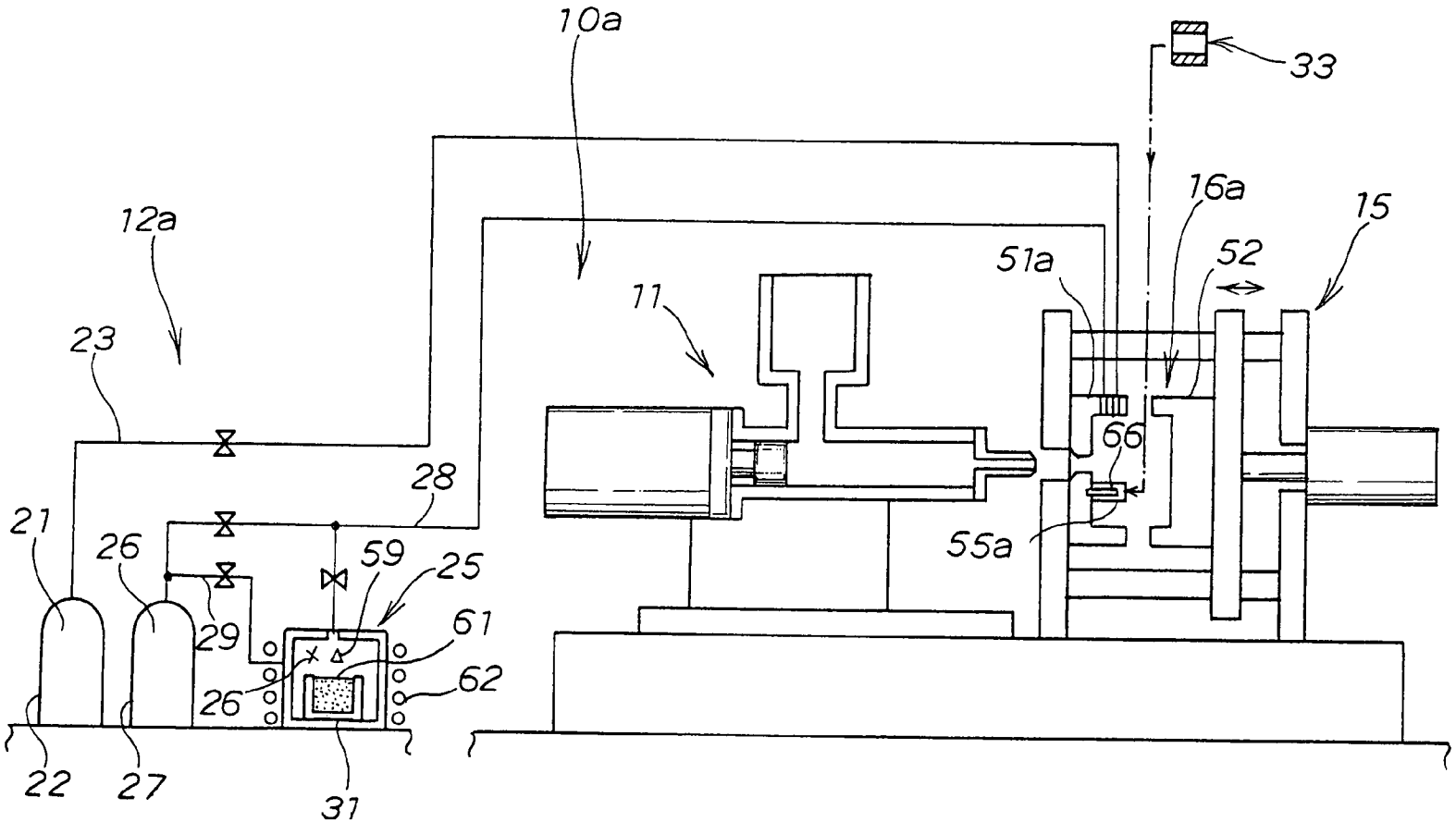
FIG. 9 shows a casting apparatus used for carrying out a cast-bonding process according to a second embodiment of the invention.

FIG. 9 shows a casting apparatus according to the second embodiment of the invention. Like numerals are used to denote like parts or materials employed according to the first embodiment, and no repeated description thereof is made.

The casting apparatus 10*a* has a gas-supplying device 12*a*. A clamping device 15 has a mold 16*a*.

The gas-supplying device 12*a* is a device obtained by removing the nitrogen heater 24 from the pipe 23 in the gas-supplying device 12 shown in FIG. 1, and no further description thereof is made. According to a salient feature of this embodiment, the mold 16*a* is heated to an appropriate temperature. More specifically, the mold 16*a* has a cartridge heater 66 installed in the cast-in insert-fitting portion 55*a* of a stationary mold portion 51*a*.

Figure 10:
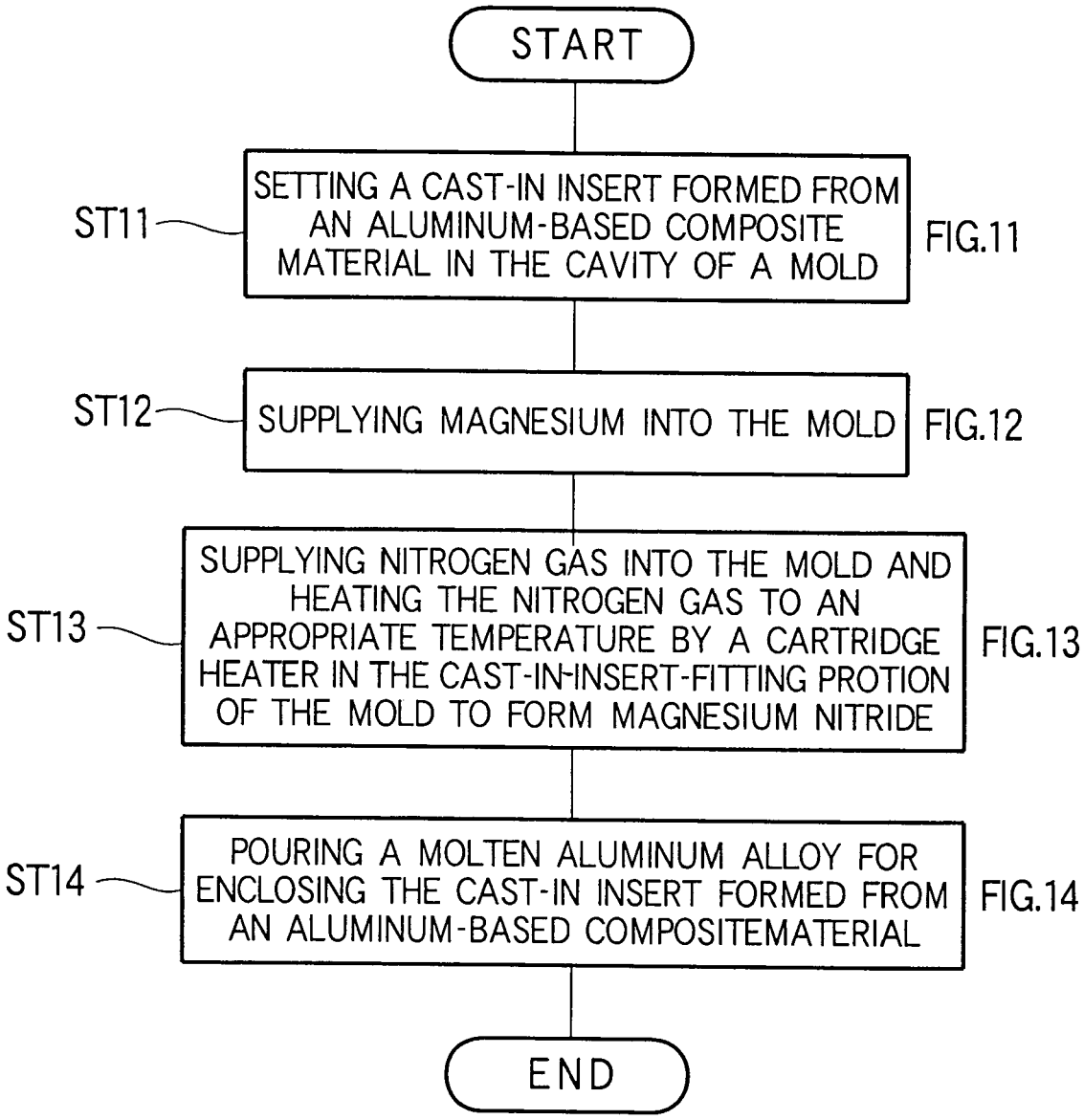
FIG. 10 is a flowchart showing the cast-bonding process in which the casting apparatus shown in FIG. 9 is employed.

FIG. 10 shows a flowchart covering the second embodiment of the invention.

ST11: The cast-in insert formed from an aluminum-based composite material is set in the cavity of the mold.

ST12: Magnesium is supplied into the mold.

ST13: Nitrogen gas is supplied into the mold and heated to an appropriate temperature by the cartridge heater in the cast-in insert-fitting portion to form magnesium nitride.

ST14: A molten aluminum alloy is poured to enclose the cast-in insert formed from an aluminum-based composite material.

Steps ST11 to ST14 will now be described more specifically with reference to FIGS. 11 to 14.

Figure 11:
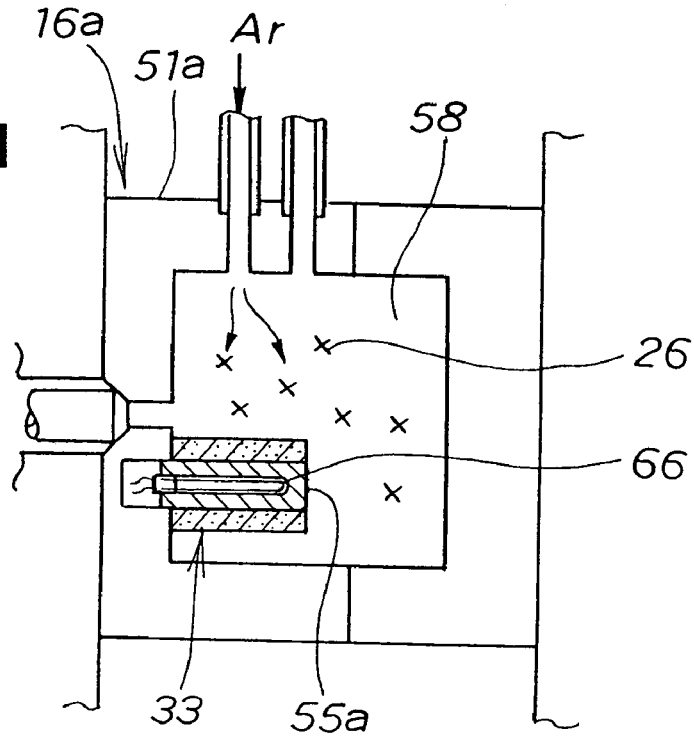
FIGS. 11 to 14 are schematic illustrations of the steps for cast-bonding according to the second embodiment.

Firstly, the cast-in insert 33 is set in the cavity 58 of the mold 16*a*, as shown in FIG. 11. More specifically, the cast-in insert 33 is mounted on the cast-in-insert-fitting portion 55*a* of the stationary mold portion 51*a*. Then, argon gas 26 is supplied into the cavity 58 of the mold 16*a*.

Figure 12:
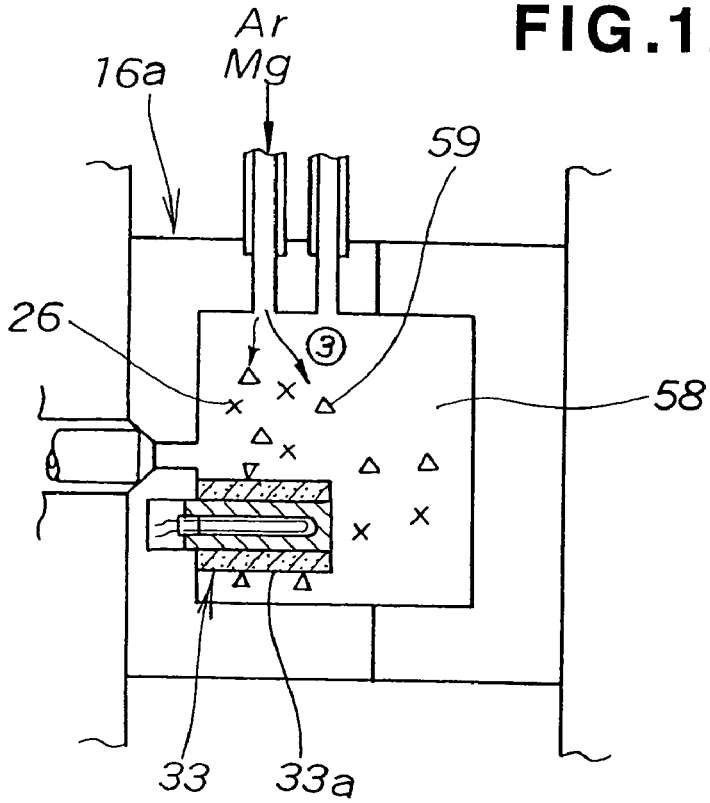

Then, magnesium gas 59 is supplied into the mold 16*a* as shown in FIG. 12. More specifically, magnesium gas 59 is supplied into the mold 16*a* with the pressure of argon gas 26, as shown by arrows (3). The magnesium-coating step serves for the same effects with the magnesium-coating step according to the first embodiment as already described. More specifically, it ensures the formation during the following step of magnesium nitride on that surface 33*a* of the cast-in insert 33 which will contact a molten alloy, since the gasified magnesium 59 coats that surface 33*a* of the cast-in insert 33 which will contact a molten alloy.

Figure 13:
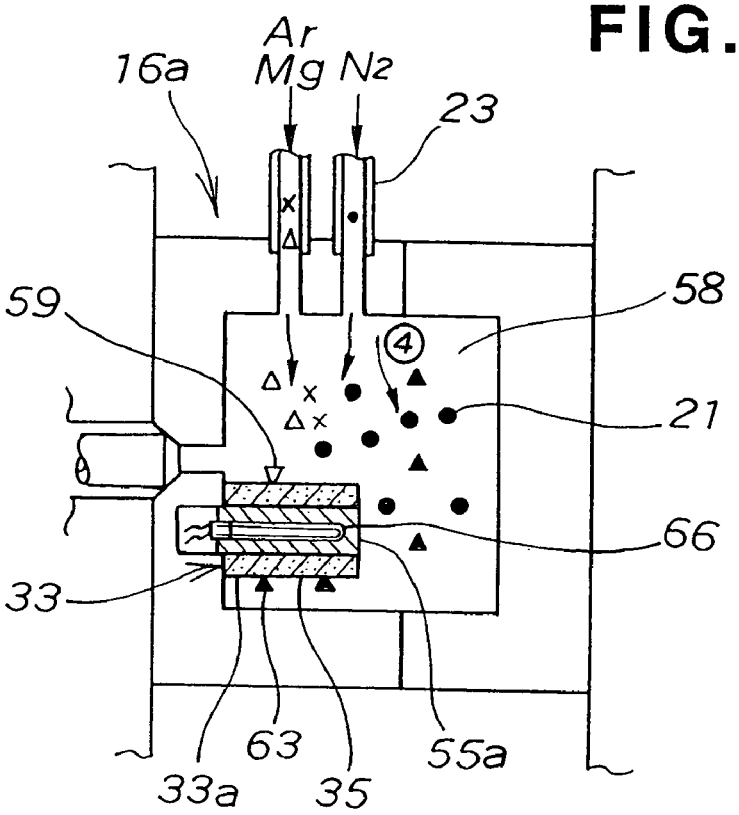

Nitrogen gas 21 is supplied into the mold 16*a* as shown in FIG. 13, and the mold 16*a* is heated to an appropriate temperature. More specifically, the vicinity of the cast-in insert 33 is heated by the cartridge heater 66 installed in the cast-in insert-fitting portion 55*a*, so that nitrogen gas 21 may be heated to an appropriate temperature, such as about 400° C., to form magnesium nitride 63.

During the magnesium nitride-forming step according to the second embodiment, the mold 16*a* into which nitrogen gas 21 has been supplied is heated to an appropriate temperature, whereby the nitrogen gas 21 in the mold 16*a* is heated to an appropriate temperature. As a result, nitrogen gas 21 undergoes an improved reaction with the coating magnesium 59 and ensures the formation of magnesium nitride 63. It is possible to ensure the reduction of any oxide film formed on the surface of the aluminum alloy on the cast-in insert surface 33*a* contacting the molten alloy, or the alumina in the aluminum-based composite material for the cast-in insert, as is the case with the first embodiment. Moreover, it is possible to reduce with magnesium nitride 63 any oxide film formed on the surface of the molten aluminum alloy that will be poured during the following step. It is, therefore, possible to achieve an improved bonding between the cast-in insert 33 formed from an aluminum-based composite material and the aluminum alloy.

Moreover, the heating of the mold 16*a* by the cartridge heater 66 in the vicinity of the cast-in insert 33 ensures the reaction of nitrogen with the magnesium 59 coating the cast-in insert 33 and the still more effective formation of magnesium nitride 63 on that surface 33*a* which will contact a molten alloy.

Moreover, the use of the cartridge heater 66 for heating the mold 16*a* ensures the heating of any desired portion of the mold 16*a* to any desired temperature and thereby the formation of magnesium nitride 63.

Figure 14:
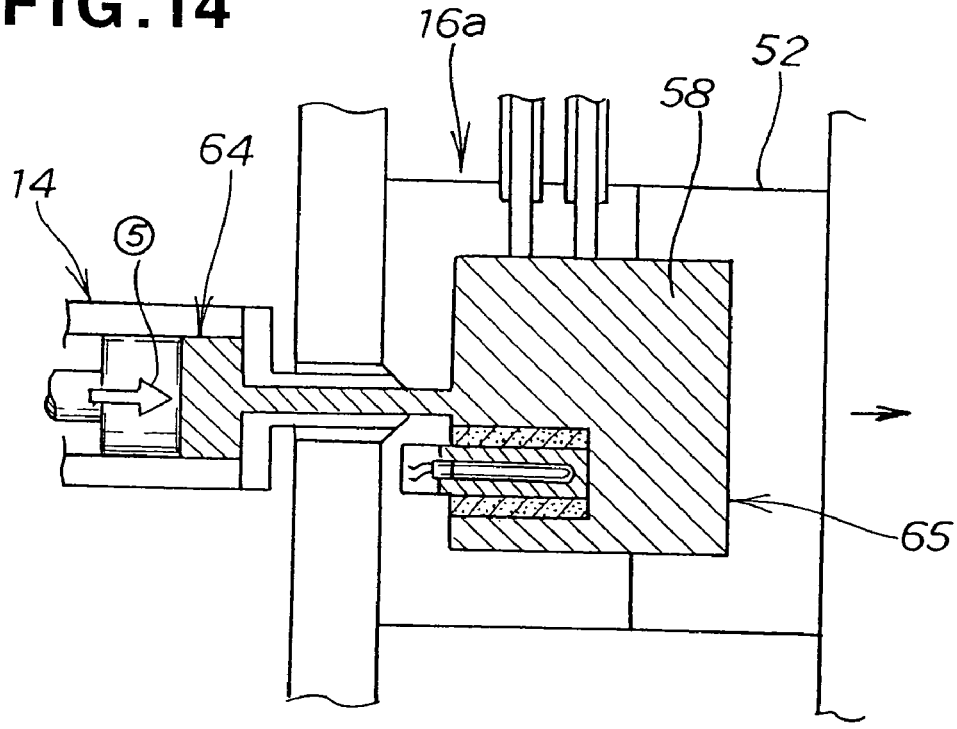

After nitriding, a molten aluminum alloy 64 is supplied at an appropriate pressure to fill the mold 16*a* as shown in FIG. 14, and when the molten alloy 64 has solidified, a casting 65 is taken out.

Figure 15A:
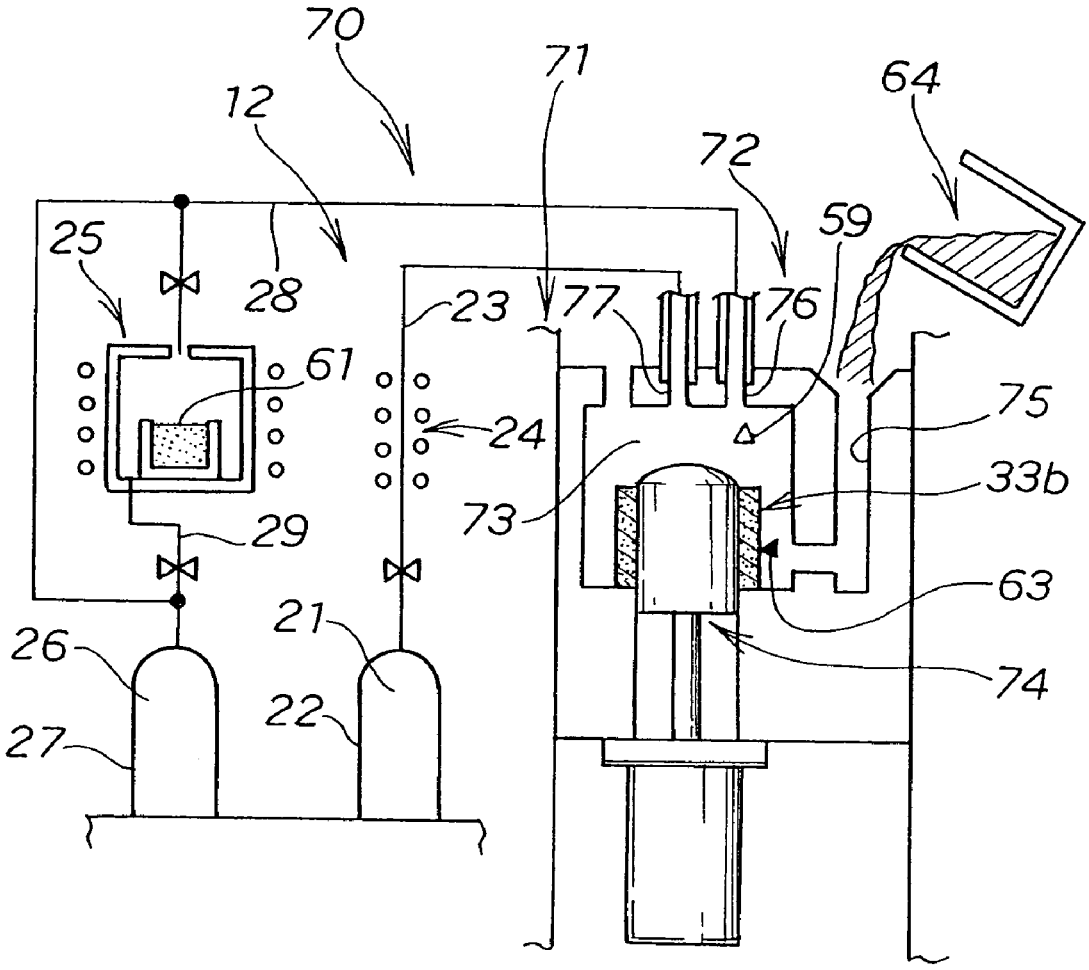
FIGS. 15A and 15B are schematic illustrations of a modified form of the first embodiment.
Figure 15B:
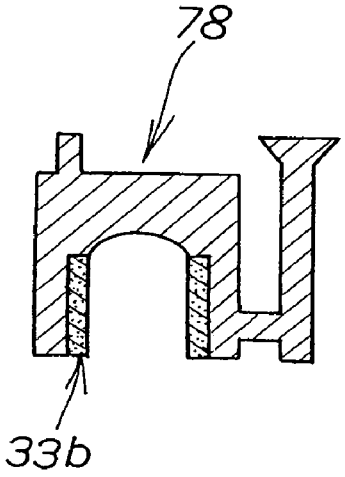

FIGS. 15A and 15B show a modified form of the first embodiment. Like numerals are used to denote like parts or materials as employed for the first embodiment and no repeated description thereof is made.

The modified casting apparatus 70 shown in FIG. 15A has a clamping device 71 and a gas-supplying device 12 and the clamping device 71 is equipped with a mold 72 into which a molten aluminum alloy 64 is cast directly at an atmospheric pressure.

The mold 72 has a cavity 73, a cast-in insert-supporting device 74 for supporting a cast-in insert 33*b*, a sprue 75 and gas supply ports 76 and 77.

The modified casting process is identical to the first embodiment in the steps up to the magnesium nitride-forming step as described with reference to FIGS. 4 to 6, and those steps will be described briefly.

Firstly, the cast-in insert 33*b* is set in the mold 72 and magnesium gas 59 is supplied into the mold 72 through the gas supply port 76 for coating the cast-in insert 33*b*. Heated nitrogen gas is supplied through the gas supply port 77 so as to react with the coating magnesium 59 to form magnesium nitride 63. Magnesium nitride 63 reduces any oxide film formed on the aluminum alloy surface of the cast-in insert 33*b*, or alumina ($Al_2O_3$) in an aluminum-based composite material. These jobs are carried out after all the holes communicating with the cavity 73, such as the sprue 75, are closed.

Then, a molten aluminum alloy 64 is poured and when the molten alloy 64 has solidified, the cast-in insert supporting device 74 is moved away and a casting is taken out. FIG. 15B shows a casting 78 enclosing a cast-in insert 33*b* formed from an aluminum-based composite material.

The formation of magnesium nitride in the mold 72 according to the modified magnesium nitride-forming step makes it possible to reduce any oxide film on the cast-in insert 33*b* and on the surface of the molten aluminum alloy 64 and thereby produce an improved wetting property therebetween. Therefore, it is possible to achieve an improved bonding between the cast-in insert 33*b* formed from an aluminum-based composite material and an aluminum alloy even if the molten aluminum alloy 64 may be cast directly into the mold 72 at an atmospheric pressure.

Although the cast-in insert 33 or 33*b* has been described as being formed from an aluminum-based composite material, it may alternatively be of an aluminum alloy. The cast-in insert may also be of any desired shape.

The mold 16, 16*a* or 72 is merely for illustration, and may be of any desired construction or may have a cavity of any desired shape. For example, it may be a sand mold.

INDUSTRIAL APPLICABILITY

This invention is particularly useful for the manufacture of an engine block having a cylinder liner, since the formation of magnesium nitride by the reaction of nitrogen gas and magnesium after the coating of a cast-in insert with magnesium makes it possible to achieve an improved bonding between the cast-in insert and an aluminum alloy forming a base structure.

The invention claimed is:

1. A cast-bonding process, characterized by comprising the steps of:

a cast-in insert setting step in which a cast-in insert formed from one of an aluminum alloy and an aluminum-based composite material is set in the a cavity of a mold such that only an outer surface of said cast-in insert is exposed to an interior of the mold;

a magnesium coating step comprising the steps of:

replacing an interior atmosphere of the mold with argon gas;

evaporating magnesium inside an atmosphere oven so as to form magnesium gas within said atmosphere oven;

supplying argon gas to the atmosphere oven;

communicating the magnesium gas, under pressure of the argon gas, from the atmosphere oven to the mold; and coating the outer surface of the cast-in insert with magnesium;

a magnesium nitride forming step in which nitrogen gas is supplied into the mold so as to react with the coated magnesium to form a magnesium nitride coating on said outer surface of said cast-in insert; and following formation of said magnesium-nitride coating, a cast-bonding step in which a molten aluminum alloy is poured into the mold such that the outer surface of the cast-in insert is enclosed by the aluminum alloy.

2. The cast-bonding process according to claim 1, wherein the magnesium nitride forming step includes heating the nitrogen gas to an appropriate temperature outside the mold to promote a reaction between the nitrogen gas and the coated magnesium.

3. The cast-bonding process according to claim 1, wherein the magnesium nitride forming step includes heating the mold in a vicinity of the cast-in insert to an appropriate temperature to promote the reaction between the coated magnesium and the nitrogen gas.

4. The cast-bonding process according to claim 3, wherein the heating of the mold is carried out by using a cartridge heater.

5. A cast-bonding process, comprising the steps of:

setting a cast-in insert into a cavity of a mold, said cast-in insert having a surface that will be in contact with a molten alloy and being formed from a material selected from the group consisting of an aluminum alloy and an aluminum-based composite material;

coating the surface of said cast-in insert with magnesium, said surface coating including the steps of:

replacing an atmosphere within the mold cavity with argon gas;

evaporating magnesium inside an atmosphere oven; and, supplying argon gas to the atmosphere oven and communicating the magnesium gas, under pressure of the argon gas, from the atmosphere oven to the mold to coat said cast-in insert surface with magnesium;

supplying nitrogen gas into said mold cavity, said nitrogen gas reacting with said magnesium coating to form a magnesium nitride coating on said cast-in insert surface; and following forming of said magnesium nitride coating, pouring a molten aluminum alloy into said mold and allowing said aluminum alloy to solidify and thereby cast-bond the cast-in insert in the solidified aluminum alloy.

6. The east-bonding process according to claim 5, wherein the nitrogen gas is heated to an appropriate temperature outside the mold to promote the reaction between the nitrogen gas and the magnesium coating.

7. A cast-bonding process according to claim 5, comprising the further step of heating the mold in the vicinity of the cast-in insert to an appropriate temperature to promote the reaction between the nitrogen gas and the magnesium coating.

8. A cast-bonding process according to claim 7, wherein heating of the mold is carried out with a cartridge heater.

* * * * *

UNITED STATES PATENT AND TRADEMARK OFFICE

CERTIFICATE OF CORRECTION

PATENT NO. : 7,040,376 B2
APPLICATION NO. : 10/484359
DATED : May 9, 2006
INVENTOR(S) : Nakao et al.

It is certified that error appears in the above-identified patent and that said Letters Patent is hereby corrected as shown below:

Column 7, Line 54, (Claim 1, Line 1), after "process," delete "characterized by".

Column 7, Line 58, (Claim 1, Line 5), after "in" delete "the".

Signed and Sealed this

Eighteenth Day of July, 2006

JON W. DUDAS
*Director of the United States Patent and Trademark Office*